US007779731B1

(12) United States Patent
Boccadutre et al.

(10) Patent No.: US 7,779,731 B1
(45) Date of Patent: Aug. 24, 2010

(54) POWER ASSISTED LEVER ARM RATCHET

(76) Inventors: Gary Boccadutre, 4 Shipley Ct., Pittstown, NJ (US) 08867; Paul V. Mannino, 144 Barbara Dr., North Plainfield, NJ (US) 07060

( * ) Notice: Subject to any disclaimer, the term of this patent is extended or adjusted under 35 U.S.C. 154(b) by 562 days.

(21) Appl. No.: 09/841,570

(22) Filed: Apr. 24, 2001

(51) Int. Cl.
*B25B 21/00* (2006.01)
*B25B 23/16* (2006.01)

(52) U.S. Cl. ..... 81/57.29; 81/57.13; 81/177.2

(58) Field of Classification Search ..... 81/57.29, 81/57.11, 57.13, 57.27, 177.2, 57.39
See application file for complete search history.

(56) References Cited

U.S. PATENT DOCUMENTS 2,808,749 A * 10/1957 Lampke ..... 81/57.13
3,430,510 A * 3/1969 Hendrickson ..... 74/425
4,215,601 A * 8/1980 Mann ..... 81/57.13
4,240,310 A * 12/1980 Roth ..... 81/57.29
4,791,836 A * 12/1988 D'Haem et al. ..... 81/57.39
5,544,553 A * 8/1996 Galat ..... 81/57.3
5,577,425 A * 11/1996 Holmin et al. ..... 81/57.39
5,709,136 A * 1/1998 Frenkel ..... 81/57.13
5,967,002 A * 10/1999 Pijanowski ..... 81/57.39
6,269,717 B1 * 8/2001 Bollinger ..... 81/177.2
6,378,400 B1 * 4/2002 Bogli ..... 81/60

OTHER PUBLICATIONS

Catalogue Listing NPL (Northern Pool & Equip., Snap-on & Dayton).

* cited by examiner

*Primary Examiner*—Hadi Shakeri
(74) *Attorney, Agent, or Firm*—Horst M. Kasper

(57) ABSTRACT

An improved power assisted lever arm ratchet which has a 6" to 30" extension and drive shaft between the ratchet handle and the ratchet head.

3 Claims, 2 Drawing Sheets

POWER ASSISTED LEVER ARM RATCHET

BACKGROUND OF THE INVENTION

1. Field of the Invention

The present invention relates to power assisted hand tools and more particularly power assisted ratchets.

2. Description of the Prior Art

Power assisted ratchets, in numerous configurations are well known in the art. Typical air, hydraulic or electric driven ratchets fall into several well-defined classifications, including gun type impact wrenches typified by a Chicago Pneumatic CP-7XX (series impact wrenches and lever arm ratchets with the gun type impact wrenches typically used for larger size sockets and lever arm type ratchets typically for smaller size ¼". ⅜" and ½" drive sockets or their metric equivalents. These lever arm ratchets also position the socket drive at the end of the ratchet in the ratchet head generally perpendicular to the long axis of the ratchet. There are also some configurations, used typically for ¼" drive sockets, in which the socket drive is mounted at the end of the device approximately in line with the long axis of the ratchet.

In the present state of the art, power assisted lever arm ratchets have the ratchet head closely coupled to a handle which typically encloses a pneumatic motor. This closely coupled configuration is used by all of the manufacturers of power assisted lever arm type ratchets including Milwaukee Pneumatic, Chicago Pneumatic, Ingersoll-Rand, Daytona, American Rodcraft, Northern Tools and Equipment Company and many others. While all of these tools are useful embodiments of power assisted lever arm ratchets, their configuration fails to address long-standing needs including accessibility in tight environments, obstruction of the users vision when working in confined areas, wrist and hand stress and hand injuries resulting from jerking or slipping ratchets. Some manufacturers have begun to address some of these problems: for example a "cushion grip" feature is used by Northern Industrial Tools on air ratchet model numbers 158308-B952 and 158309-B952, Snap-On uses a "Santroprene" "ergonomic handle", NAPA ratchet model NPT 6-731 features a "comfortable ergonomic motor housing" and Dayton offers a model 52273 "ergonomic reactionless ratchet" which it suggests "eliminates torque reaction, which means no more bloody or bruised knuckles when working in tight areas". However, the current state of the art as embodied in the numerous examples cited above do not address the accessibility or view obstruction problems except by trying to make the ratchets more compact, which exacerbates the potential for injury by requiring the user's hand to be closer to the machinery. In addition, aside from the "ergonomic" grips or attempts to reduce the occurrence of torque reaction jerking or slipping of a ratchet, noting in the prior art addresses the problems of hand/arm injuries or stress and strain induced repetitive motion injuries.

SUMMARY OF THE INVENTION

It is a general objective of the present invention to provide for an improved power assisted lever arm ratchet which addresses these long-standing needs and provides for an improved design.

It is an object of the present invention to provide the user with an improved power assisted lever arm ratchet that reduces the force and grip strength needed to hold the ratchet during use.

It is a further object of the present invention to provide an improved power assisted lever arm ratchet that is able to reach otherwise inaccessible locations in engine compartments in automotive repair and assembly operations as well as similar situations involving other types of equipment.

It is also an object of the present invention to provide for an improved power assisted lever arm ratchet allows the user to grip the ratchet in a position removed from the immediate vicinity of the work area such that the users hand is not subject to injury if the ratchet jerks or slips causing the user's hand to impact on the equipment.

It is an additional object of the present invention to provide for an improved power assisted lever arm ratchet which permits the user to position the user's hand away from the work area to reduce obstruction of the user's view of the area of the equipment being worked on.

It is also an object of the present invention to provide for a device that can be added to existing power assisted lever arm ratchets to provide the improvements embodied in this invention.

Is an additional objective of the present invention to provide for variable length extenders to power assisted lever arm ratchets to accomplish the improvements embodied in this invention.

It is also an object of the present invention to provide a power assisted lever arm ratchet which has fixed or removable user selected extensions to accomplish the improvements embodied in the present invention.

BRIEF DESCRIPTION OF THE DRAWINGS

The following drawings illustrate the preferred embodiment of the within invention as well as alternative embodiments.

DETAILED DESCRIPTION OF THE DRAWINGS

Figure 1:
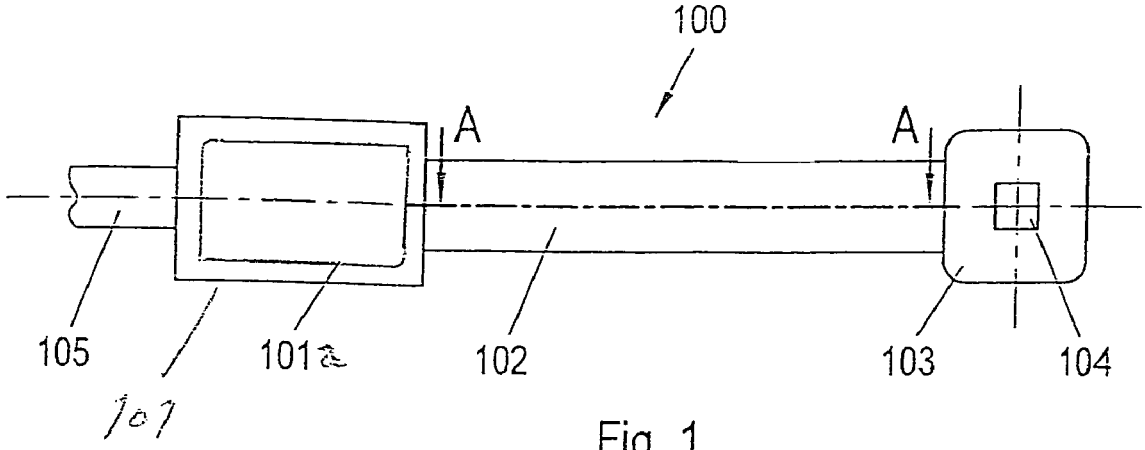
FIG. 1 is a prospective view of a power assisted lever arm ratchet embodying the features of the present invention.

Referring to FIG. 1 which illustrates improved power assisted lever arm ratchet 100 which is further comprise of ratchet handle 101, which handle typically encloses powered drive motor 101(*a*), ratchet extension 102, ratchet head 103, which head typically encloses a right angle drive mechanism, socket mount 104 and air line connection 105. In the preferred embodiment, ratchet extension 102 is approximately 11 inches in length. However, extensions from approximately six inches to as much as thirty inches are considered to be useful and are contemplated by the present invention.

Figure 2:
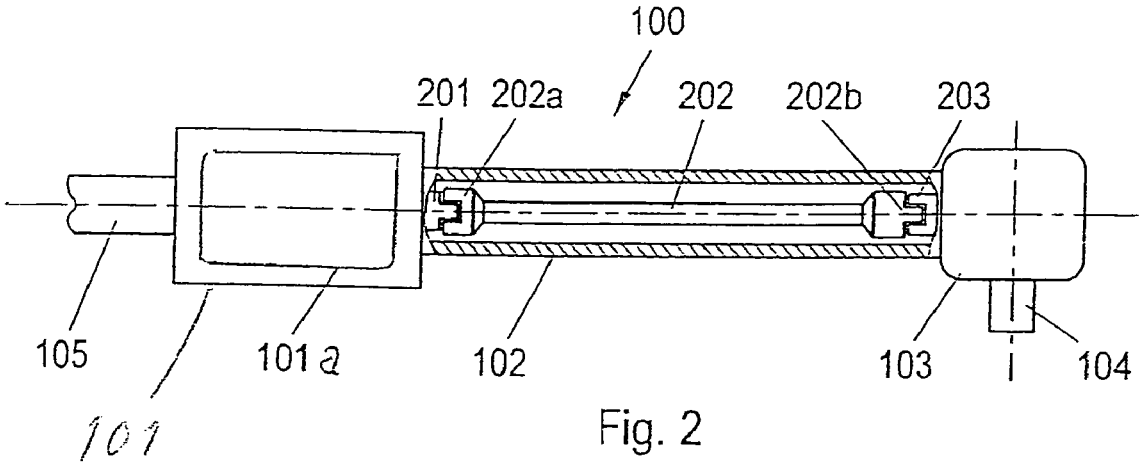
FIG. 2 is a cross-section view of the preferred embodiment of the present invention.

FIG. 2 illustrates improved power assisted lever arm ratchet 100 viewed through section line A-A in FIG. 1 and illustrates extension shaft 202 which is located inside of ratchet extension 102. Drive shaft 201 engages drive socket 202 A on drive extension shaft 202. Drive extension shaft 202 then engages ratchet head drive shaft 203 via drive tang 202 B. The advantage of drive extension shaft 202 having drive socket 202 A and drive tang 202 B facilitates the manufacturing of improved lever arm ratchet 100 with various extension lengths while permitting ratchet handle 101 and ratchet head 103 to be manufacturing in a standard configuration. Embodiments in which drive shaft 202 extends through ratchet extension 102 to engage directly with head drive shaft 203 is also a contemplated by the present invention as is a configuration in which a drive shaft from ratchet handle 101 is connected directly to ratchet head 103 as well as extending head drive shaft 203 to engage drive shaft 202 at ratchet handle 101. In all of the foregoing embodiments ratchet handle 101 is fixedly or removablely attached to ratchet head 103 by means of ratchet extension 102 such that the position of ratchet handle 101 relative to ratchet head 103 is maintained when ratchet 100 is activated for normal use such as attaching or removing fasteners.

Figure 3:
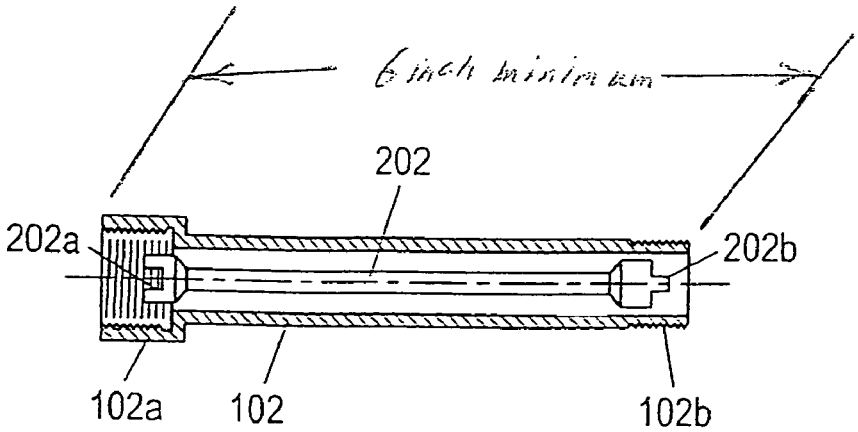
FIG. 3 illustrates the components needed to convert a conventional power assisted lever arm ratchet into one incorporating the features of the present invention.

FIG. 3 illustrates an embodiment of drive extension 102 which is designed for use with existing air ratchets to incorporate the drive extension features of the present invention. In this embodiment drive extension 102 incorporates interface collar 102 A and ratchet head mount 102 B in addition to drive extension shaft 202. Some embodiments of existing power assisted lever arm ratchets are designed to facilitate repair or replacement of components by permitting ratchet head 103 to be detached from ratchet handle 101. There are various methods of attaching these compounds together and for illustration purposes a threaded connection involving male threads located on the end of ratchet handle 101 engaging a threaded collar on ratchet head 103 is shown. In this embodiment of the present invention interface collar 102 A is threaded onto the male threads located on the end of ratchet handle 101. Interface thread 102B is threaded into the threaded collar on ratchet head 103. Drive extension shaft 202 via drive socket 202A engages drive shaft 201 in the same manner as head drive shaft 203 the other end of drive extension shaft 202 via drive tang 202 B engages head drive shaft 203. FIG. 3 illustrates a slot/tang drive shaft engagement configuration which is one of several used in existing air ratchets. However the present invention contemplates any configuration in which ratchet head 103 is removeably attached to ratchet handle 101 as well as any detachable or fixed drive shaft configuration.

Figure 4A:
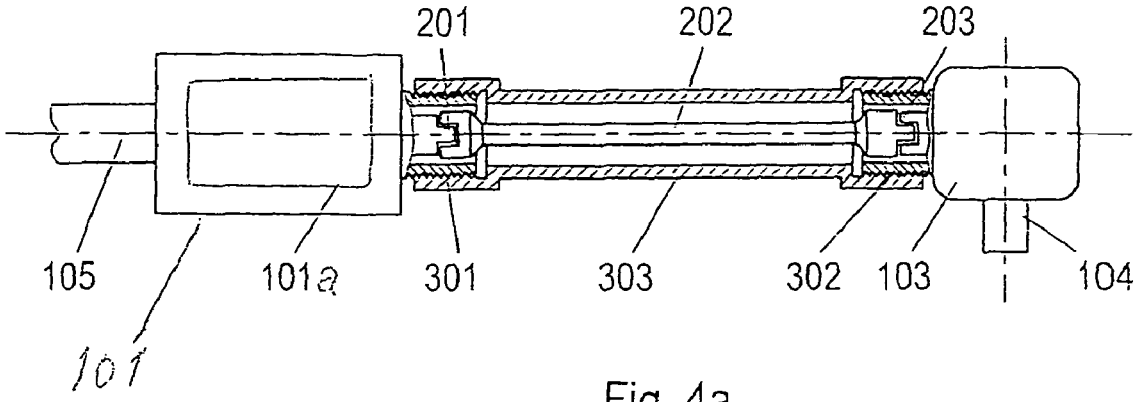
FIGS. 4A and 4B illustrate embodiments of the present invention with a replaceable extension to provide for different length ratchet extensions.
Figure 4B:
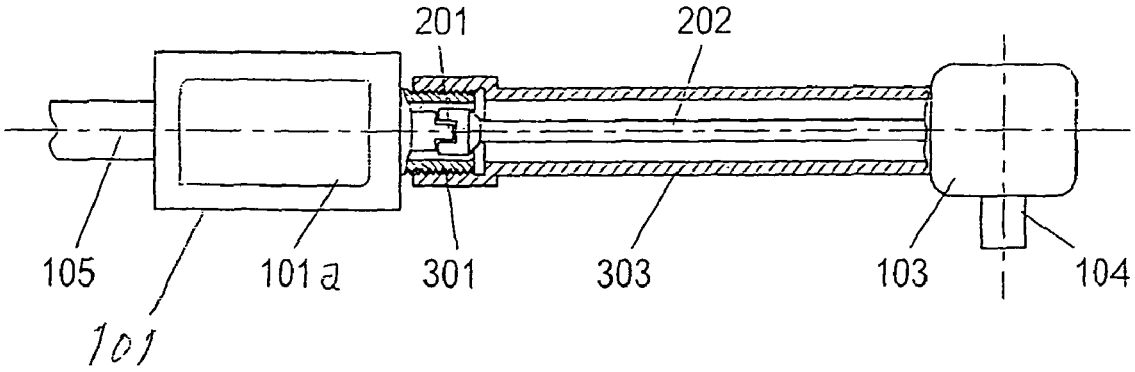

FIGS. 4 A and 4B illustrate additional embodiments of the present invention providing for replaceable extensions of different lengths. In FIG. 4A ratchet handle 101 incorporates drive extension sleeve mounting collar 301 and drive extension mounting collar 302 which is incorporated into ratchet head 103. Drive extension shaft 202 of an appropriate length is engaged with either drive shaft 201 or ratchet head drive shaft 203 and extension sleeve 303 in an appropriate length is slipped over drive extension shaft 202, the unengaged end of drive extension shaft 202 is engaged with either drive shaft 201 or ratchet head drive shaft 203 and extension sleeve 303 is removablely attached to drive extension sleeve mounting collar 301 and drive extension collar 302 completing the assembly of this embodiment of the present invention. In FIG. 4B extension sleeve 303 is fixedly attached to ratchet head 103 and ratchet head drive shaft 203 is extended to a length appropriate, when used with extension sleeve 303, to engage drive shaft 201 when extension sleeve 303 is removably attached to drive extension sleeve mounting collar 301. It is clear that other alternative embodiments are possible and contemplated by the present invention including the attachment of extension sleeve 303 to ratchet handle 101 and extending drive shaft 201 or various combinations of extension sleeves and drive shafts coupled at any point to permit easy assembly and disassembly to change the length of the extension.

The present invention as described in the foregoing can be seen as providing an improved power assisted lever arm ratchet design which provides for easy access to inaccessible or awkwardly accessible portions of mechanical devices for assembly and/or repair. The present invention also provided for reduced stress on the user when the ratchet is activated and applies torque to attach or remove fasteners due to the extension and increased lever arm length provided by this improved ratchet. The length of the extension can be selected based on the additional reach desired by the user as well as the amount of torque reduction desired.

The particular embodiments of the preferred invention and alternatives which have been shown and described above are intended to be illustrative of the features of the present invention, however it is obvious onto those skilled in the art that changes and modifications can be readily made without departing from the scope of the present invention. It is therefore intended that all such changes and modifications fall within the scope of the present invention.

We claim:

1. An improved power assisted lever arm ratchet wrench comprising:

a handle containing an air drive motor, an air line connection furnished to the handle;

a threaded drive extension sleeve mounting collar mounted on the handle;

a drive shaft protruding from the handle and surrounded by the threaded drive extension sleeve mounting collar;

an extension sleeve having a first end formed as threaded interface and having a second end formed as an interface thread, wherein the first end of the extension sleeve is attached to the threaded drive extension sleeve mounting collar of the handle;

an extension shaft having a first end and a second end, wherein the extension shaft is disposed substantially parallel to the extension sleeve;

a drive socket attached to the first end of the extension shaft and connected to the drive shaft protruding from the handle;

a drive tang formed at the second end of the extension shaft;

wherein support of the extension shaft consists of the first end of the extension shaft attached to the drive socket and of the second end of the extension shaft attached to the drive tang;

wherein a length between an engagement point of the drive socket of the extension shaft and an engagement point of the drive tang of the extension shaft is essentially equal to a length between an engagement point of the threaded interface of the extension sleeve and an engagement point of the interface thread of the extension sleeve;

a ratchet head having a drive shaft and having a threaded collar attached to the interface thread of the second end of the extension sleeve and wherein the drive tang of the second end of the extension shaft is attached to the drive shaft of the ratchet head;

wherein the extension shaft is unsupported apart from support furnished to the drive socket of the first end of the extension shaft and to the drive tang of the second end of the extension shaft; and wherein the handle is directly and operably attachable/detachable to the ratchet head by connecting/disconnecting the drive shaft of the handle to/from the drive shaft of the ratchet head via the extension shaft, connecting/disconnecting the threaded drive extension sleeve mounting collar mounted on the handle to/from the threaded interface and by connecting/disconnecting the interface thread to/from the threaded collar of the ratchet head.

2. The improved power assisted lever arm ratchet wrench according to claim 1 in which said extension sleeve and extension shaft are approximately six to thirty inches in length.

3. The improved power assisted lever arm ratchet wrench according to claim 1 wherein a plurality of extension shafts and corresponding extension sleeves of different sizes are provided defining an extension kit.

* * * * *